US006695313B1

(12) United States Patent
Blane

(10) Patent No.: US 6,695,313 B1
(45) Date of Patent: Feb. 24, 2004

(54) PLAYING CARD DECK PARTICULARLY SUITED FOR BLACKJACK

(76) Inventor: James M. Blane, 3341 S. Locust St., Denver, CO (US) 80222

( * ) Notice: Subject to any disclaimer, the term of this patent is extended or adjusted under 35 U.S.C. 154(b) by 0 days.

(21) Appl. No.: 10/237,764

(22) Filed: Sep. 9, 2002

(51) Int. Cl.[7] ..... A63F 1/00

(52) U.S. Cl. ..... 273/307; 273/292; D21/376; D21/379

(58) Field of Search ..... 273/292, 303–306, 273/307; D21/376–379

(56) References Cited

U.S. PATENT DOCUMENTS 298,991 A * 5/1884 Levey ..... 273/305
491,302 A 2/1893 Ames
660,004 A 10/1900 Christie
D88,324 S 11/1932 Shaffer
2,006,521 A 7/1935 Stone
2,133,746 A 10/1938 Hawgood
D230,617 S 3/1974 Ekstrand
4,014,549 A 3/1977 Cywar
D340,265 S 10/1993 St. Pierre
D368,284 S 3/1996 Cauda
5,518,249 A 5/1996 Sines et al.
5,895,048 A 4/1999 Smith, Jr.
6,241,250 B1 6/2001 Webb

* cited by examiner

*Primary Examiner*—Benjamin H. Layno
(74) *Attorney, Agent, or Firm*—Quinn & Quinn, P.C.; William J. Quinn; Cornelius P. Quinn

(57) ABSTRACT

A playing card deck particularly suited for the play of the card game of blackjack where indicia that is irrelevant to play of the game has been eliminated to facilitate play and increase the pace of play of the game. The invention comprises a deck of fifty two playing cards with the cards of the deck having no indications for suits and having four cards each with value indications of ace, two, three, four, five, six, seven, eight, and nine, with the remaining sixteen cards having value indications of ten.

10 Claims, 2 Drawing Sheets

PLAYING CARD DECK PARTICULARLY SUITED FOR BLACKJACK

FIELD OF THE INVENTION

The present invention pertains to playing card decks and particularly to playing card decks for use in playing the casino game known as blackjack or twenty-one.

BACKGROUND OF THE INVENTION

Rules to and play of the game of blackjack, often called twenty-one, and numerous variations to the rules are well known in the prior art.

In the play of the card game blackjack, one or more players each play a hand of cards against a hand of cards held and played by the dealer. The object of the game for each player is to achieve a combined count of the card values in their hand that is greater than the combined count of the card values of the dealer's hand, without exceeding twenty-one, when the combined count of the card values of the dealer's hand does not exceed twenty-one, or to simply achieve a combined count of the card values in their hand not exceeding twenty-one where the combined count of the card values in the dealer's hand exceeds twenty-one. Typically one or more standard fifty-two card playing decks are utilized. Each deck is composed of four suits of thirteen cards each; each suit contains one each of numerically indicated cards of two, three, four, five, six, seven, eight, nine, and ten, one each of the face cards jack, queen and king and each suit also contains an ace. In play of the game blackjack, each numerically indicated card is assigned the value that is numerically indicated, all face cards are assigned the value of ten, and each ace is utilized as either 1 or 11 in such fashion as to achieve the greatest combined count of the card values in a hand without exceeding twenty-one, if possible.

In play of the game of blackjack, the dealer deals two cards to each player and to the dealer. Although, according to variations in the rules, the two cards dealt to each player may be both dealt face up or face down the dealer receives one card face up and one card face down. After two cards are dealt to each player and the dealer, each player in turn may proceed in play with various options depending on variation in the rules such as standing, hitting, splitting and doubling down; in proceeding with play, a player directs the dealer to deal zero, or one or more additional cards to the players hand. If the combined count of the card values in the players hand exceed twenty-one the player immediately loses, but if the combined count of the card values in the players hand does not exceed twenty-one then the players hand remains in play and the next player proceeds to play. After all other players have proceeded, the dealer proceeds last. The dealer, according to the variation of the rules employed is directed to take cards until a combined count of the card values in his hand is at or above a-certain value, typically seventeen.

A two card hand that contains an ace and a card with a value of ten is referred to as a "blackjack." If the dealer's initially dealt two cards are a "blackjack", then the dealer wins, with the only exception being if the player also has a "blackjack."

It is an objective of casinos to move the hands along as fast as possible at the blackjack tables. Simply, the greater the number of hands that can be played in a given amount of time equates to a greater potential profit for the casinos.

Although blackjack, and particularly blackjack in casinos, is played with one or more standard fifty-two card decks, in play of the game, the suit of any given card is irrelevant, with the value of that card being the single relevant factor for play. Therefore, the suit indicating pips contained on the cards of a standard fifty two card deck are not necessary, and may cause delay in some players, such as the novice player, in that these insignificant indicators congest the information on the card and distract the player from the value indicator. Additionally, in play of blackjack with one or more standard fifty-two card decks, the numerically indicated cards ten as well as the jacks queens and kings are all assigned a value of ten for play; assigning all of these cards with different appearances a value of ten may also cause delay with some players such as the novice player. Still further, in a standard fifty-two card deck, the heart and diamond suit cards are indicated with red value indicators and pips, and the club and spade suit cards are indicated with black value indicators and pips; although insignificant to the play of blackjack, these color indications may also lead to delay with some players.

Unlike blackjack, with other common card games, such as poker, gin rummy and others that utilize a standard fifty-two card playing deck, the suits have significance and the tens, jacks, queens and kings have separate significance from each other. From playing these other common card games, players who also may play blackjack, have learned to take account of the suits of the cards dealt to them and to place separate significance upon tens, jacks, queens and kings.

Although there are many variations in cards known in the prior art that are suitable for use in play of the game of blackjack and for learning strategy in the game of blackjack, such as U.S. Pat. No. 5,518,249 to Sines at al., U.S. Des. Pat. No. 368,284 to Cauda, U.S. Des. Pat. No. 340, 265, U.S. Pat. No. 5,895,048 to Smith, Jr., and U.S. Pat. No. 4,014,549 to Cywar, none of these playing card decks of the prior art is particularly suited to fully facilitate play of the game of blackjack.

SUMMARY OF THE INVENTION

It is the objective of the present invention to provide a deck of playing cards that is particularly suited for the play of blackjack and facilitates a player's ability to rapidly ascertain the value of their hands so that the player can make decisions on the play of the, hand without unnecessary delay.

The objective of the present invention is attained by a deck of fifty-two playing cards of the present invention, which may be utilized in single or multiple deck play.

In a first embodiment of the present invention a playing card deck is provided which consists of fifty-two separate cards. The backs of the cards are all indistinguishable from one another such that the value of any given card cannot be ascertained by viewing the back of the card; the back of the cards may be blank or consist of an ornamental design. Upon the face of each card is indicated the value given to the card. Such indication is preferably provided on face of the card's upper left hand corner and inverted upon the face of the card's lower right hand corner so that the value indication appears at the same locations regardless of whether the card has been inverted. The fifty-two card deck is composed of four cards each with value indications of ace, two, three, four, five, six, seven, eight and nine, and sixteen cards with value indications of ten. The value indications of the cards are all of the same color and no pips or suit indicators are placed on the cards.

By eliminating the pips and suit indicators, and providing value indicators of a single color, irrelevant and surplus information to the play of blackjack is removed from the face of the cards. Further, with the replacement of the jacks, queens and kings that are ordinarily present in a standard fifty-two card deck with cards with value indicators of ten, the value of these cards is more rapidly ascertained. Additionally, with the elimination of the pips and suit indicators, the value indicators may be easily enlarged so that players with less than optimal eye sight can assess the value of the cards in their hand without undue eye strain, and thereby reduce mistakes in play while increasing their rate of play.

In a second embodiment of the present invention, the fifty two card deck of the first embodiment has additional value indicators of eleven placed in near proximity to the ace value indicators on the ace value cards to remind a player that the ace may be valued at one or eleven.

In a third embodiment of the present invention, the fifty two card deck of the first embodiment has additional value indicators of eleven placed in the center of the face on the ace value cards to remind a player that the ace may be valued at one or eleven.

In a forth embodiment of the present invention, the fifty two card deck of the first embodiment has additional value indicators of eleven placed on the face of the ace value cards in the adjacent upper corner to the corresponding ace value indicator on the upper end of the card and inverted in the adjacent lower corner to the corresponding ace value indicator on the lower end of the card to remind a player that the ace may be valued at one or eleven.

As a further variant in all of the foregoing embodiments, the value indicators may be printed in distinct colors to highlight the significance of certain card values for play of the game. It is believed that by printing the value indicators of the ten value cards a separate and distinct color from the ace and two through nine value cards, and printing the ace value cards a separate and distinct color from the ten and two through nine value cards, leads to more rapid recognition of the combined value of card combinations in a players hand containing these cards. One such coloration scheme that highlights the significance of the ace and ten value cards is to print the two through nine value cards with black value indicators, the ten value cards with red value indicators and the ace value cards with green value indicators.

In the forgoing embodiments of the present invention, with the exception of the ace value cards of the third embodiment, the center of the face of each card of the playing card deck of the present invention contains no depictions or indications relevant to the value of the card, such as with the pips and jack, queen and king depictions in a standard fifty-two card playing card deck. As such, in an additional variation of the playing card decks of the present invention, this central area on the face of the cards of the foregoing embodiments may be utilized to print a casino's logo or other identifying information as well as for printing advertising. And since this area is upon the face of the card, the material printed in this area does not have to be consistent throughout all of the cards in the deck to prevent the value of the card from being inadvertently disclosed.

Other objects, advantages and novel features of the present invention will become apparent from the following drawings and detailed description of the preferred embodiments.

DETAILED DESCRIPTION OF THE PREFERRED EMBODIMENTS

Figure 1:
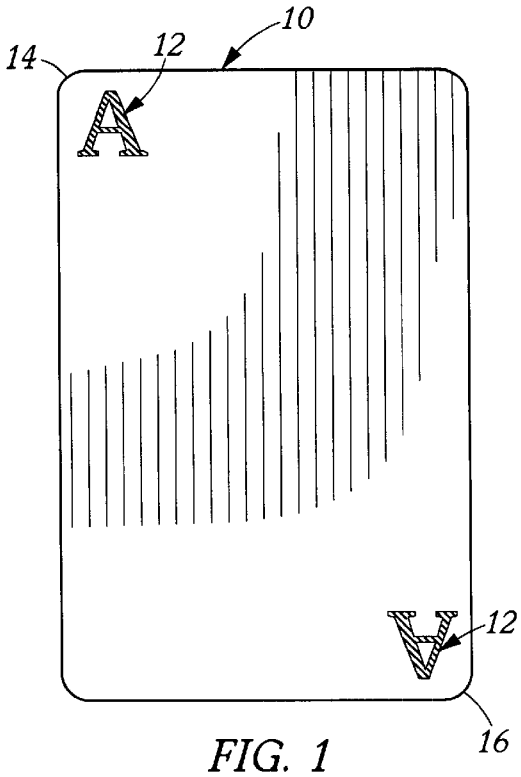
FIGS. 1, 2 and 3 show the faces of an ace value card of the first embodiment of the present invention, a ten value card of the first through forth embodiments of the present invention and an exemplar of the layout of the card face utilized with the cards of value two through nine of the first through forth embodiments of the present invention.

The first embodiment of the present invention will now be described with reference to FIGS. 1 through 3.

A deck of fifty-two playing cards all of a size, shape and weight of a typical card used in playing card games in a casino is provided. The face of each card 10 has value indicators 12 disposed near a top corner 14 and near an opposite bottom corner 16 in inverted orientation. No indications of suit are provided on the face of the cards, as suits are irrelevant in the play of the game of blackjack. The deck is composed of four cards 10 with a value indicators 12 of ace, as depicted in FIG. 1, sixteen cards 10 with a value indicators 12 of ten, as depicted in FIG. 2 and four each of cards 10 with value indicators 12 of two, three, four, five, six, seven eight and nine, as depicted in the exemplar of the layout of the card face in FIG. 3. No face cards are provided in the deck, as cards 10 with value indicators 12 of ten have been substituted for the face cards with value indicators of jack, queen and king that are present in an ordinary playing card deck, since the jack, queen, and king value indicators in an ordinary playing card deck do nothing more than indicate a card value of ten in the game of blackjack.

Figure 2:
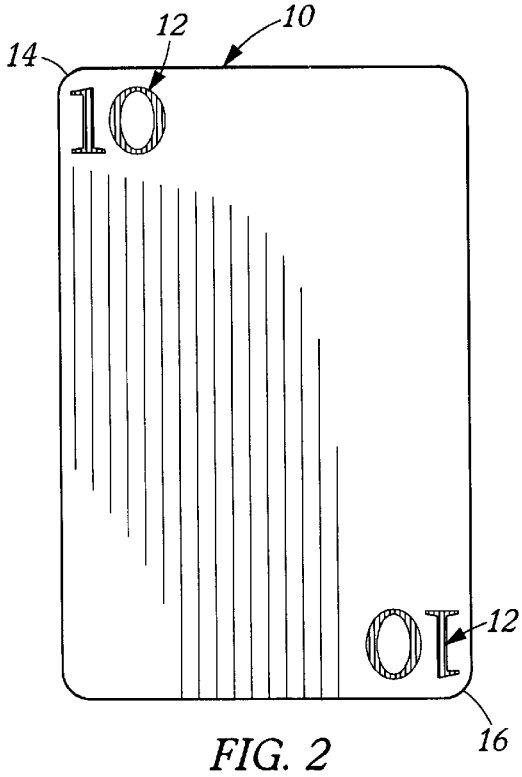
Figure 3:
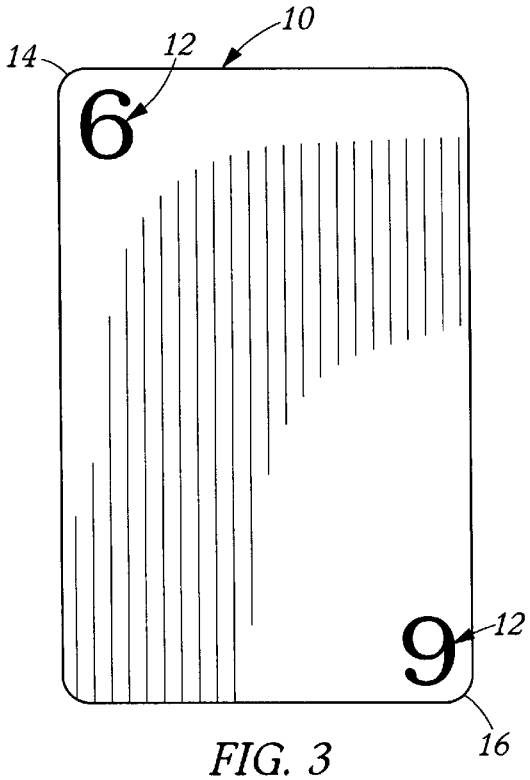
Figure 4:
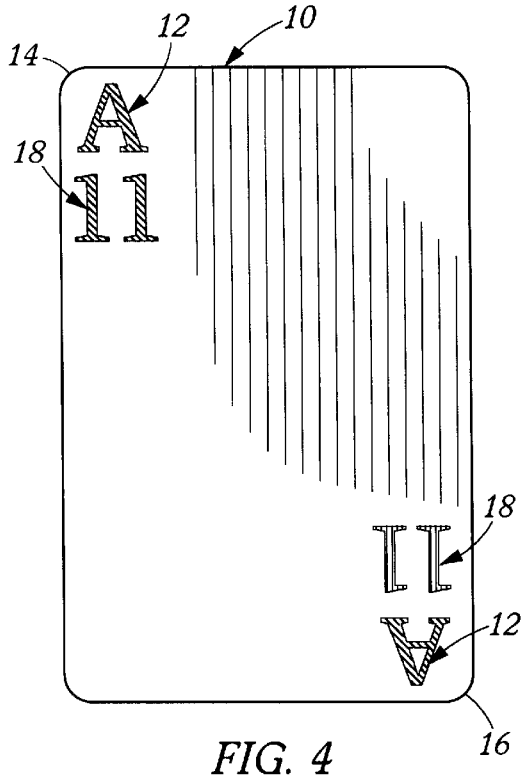
FIG. 4 shows the face of an ace value card of the second embodiment of the present invention.

Referring to FIGS. 2 through 4, in the second embodiment of the present invention the same fifty-two card playing deck as in the first embodiment is provided, having sixteen cards 10 with value indicators 12 of ten, as depicted in FIG. 2 and four each of cards 10 with value indicators 12 of two, three, four, five, six, seven eight and nine, as depicted in the exemplar of the layout of the card face in FIG. 3; However, in this second embodiment of the present invention, four ace cards 10 as depicted in FIG. 4 are substituted for the four ace cards 10 of the first embodiment. The four ace cards 10 of this second embodiment have value indicators 12 displaying the ace value disposed near a top corner 14 and near an opposite bottom corner 16 in inverted orientation; additionally the four ace cards 10 have secondary value indicators 18 displaying an eleven value disposed near the top corner 14 in near proximity to the value indicator 12 and near an opposite bottom corner 14 in inverted orientation and in near proximity to the value indicator 12. The secondary value indicators 18 in this second embodiment serves to remind the player that the ace card may be valued at one or eleven.

Figure 5:
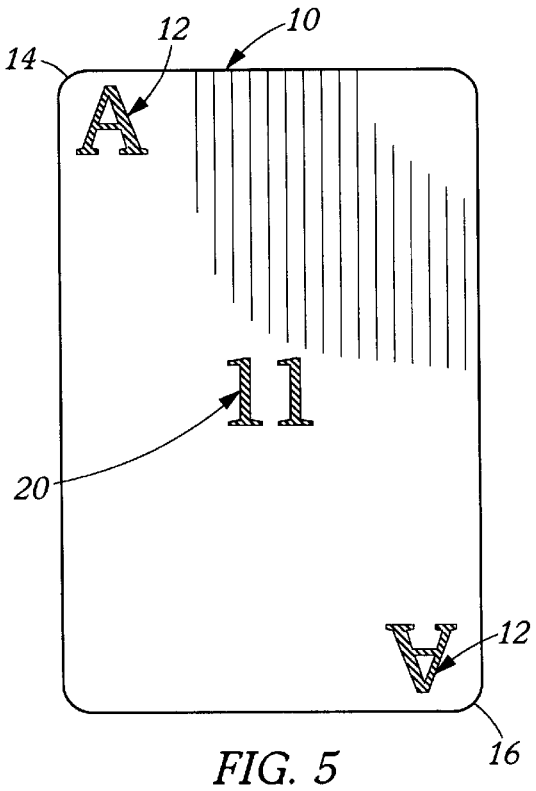
FIG. 5 shows the face of an ace value card of the third embodiment of the present invention.

Referring to FIGS. 2, 3 and 5, in the third embodiment of the present invention the same fifty-two card playing deck as in the first embodiment is provided, having sixteen cards 10 with value indicators 12 of ten, as depicted in FIG. 2 and four each of cards 10 with value indicators 12 of two, three, four, five, six, seven eight and nine, as depicted in the exemplar of the layout of the card face in FIG. 3; However, in this third embodiment of the present invention, four ace cards 10 as depicted in FIG. 5 are substituted for the four ace cards 10 of the first embodiment. The four ace cards 10 of this third embodiment have value indicators 12 displaying the ace value disposed near a top corner 14 and near an opposite bottom corner 16 in inverted orientation; additionally the four ace cards 10 each have a central value indicator 20 located at or near the center of the face of the card and displaying an eleven value. The central value indicator 20 in this third embodiment serves to remind the player that the ace card may be valued at one or eleven.

Figure 6:
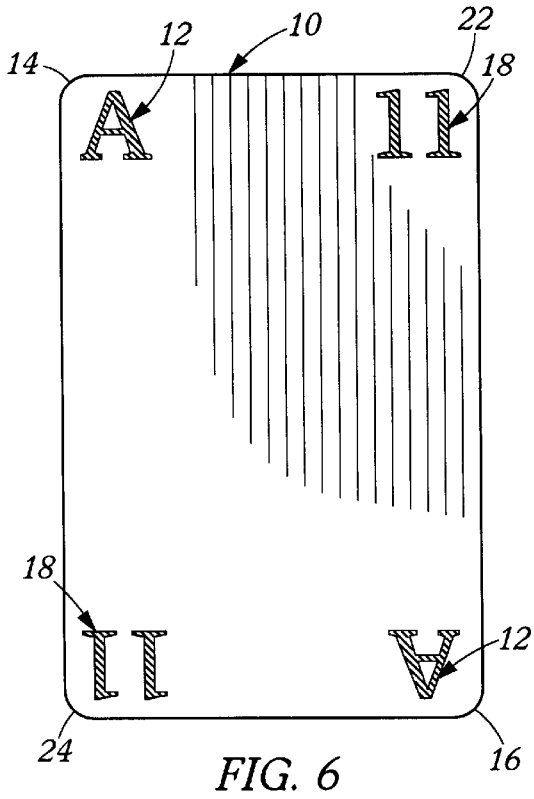
FIG. 6. shows the face of an ace value card of the forth embodiment of the present invention.

Referring to FIGS. 2, 3 and 6, in the forth embodiment of the present invention the same fifty-two card playing deck as in the first embodiment is provided, having sixteen cards 10 with value indicators 12 of ten, as depicted in FIG. 2 and four each of cards 10 with value indicators 12 of two, three, four, five, six, seven eight and nine, as depicted in the exemplar of the layout of the card face in FIG. 3; However, in this forth embodiment of the present invention, four ace cards 10 as depicted in FIG. 6 are substituted for the four ace cards 10 of the first embodiment. The four ace cards 10 of this forth embodiment have value indicators 12 displaying the ace value disposed near a top corner 14 and near an opposite bottom corner 16 in inverted orientation; additionally the four ace cards 10 have secondary value indicators 18 displaying an eleven value disposed near a second top corner 22 that is the adjacent top corner to the top corner 14 and disposed in inverted orientation near a second bottom corner 24 that is the adjacent bottom corner to the bottom corner 16. The secondary value indicators 18 in this second embodiment serves to remind the player that the ace card may be valued at one or eleven.

Referring to FIGS. 1 through 6 and all the above preferred embodiments, a further variant suitable for application in any of the foregoing embodiments is that the value indicators 12, and the secondary value indicators 18, if present and the central value indicators 20, if present, of cards 10 may be printed in distinct colors to highlight the significance of certain card values for play of the game.

Figure 7:
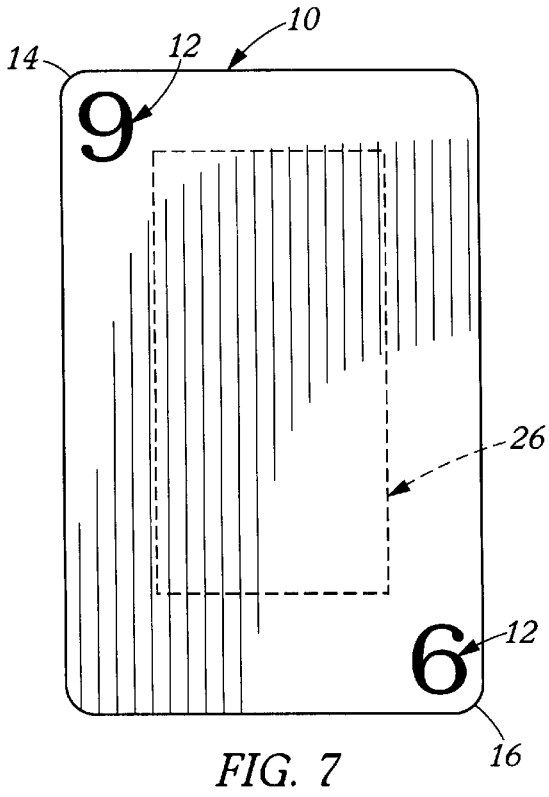
FIG. 7. shows an exemplar of the layout of the card face variant indicating where a logo or other identifying or advertising material may be placed upon the face of cards of all embodiments of the present invention other than the ace value cards of the third embodiment.

Referring to FIG. 7 and the forgoing embodiments and variant of the present invention, a further variant is depicted in FIG. 7 to provide for the inclusion of a casino's logo or other identifying information or advertising, which would be suitable for placement upon any of the cards of the various embodiments of the present invention except for the ace cards of the third embodiment as depicted in FIG. 5. Cards 10 as depicted in FIGS. 1 through 4 and 6 have an area 22 defined by a frame centrally located on the face of the card 10 and interior to value indicators 12 and secondary value indicators 18, if present. This area 22 in this variant of the embodiments of the present invention is utilized to print a casino's logo, other identifying information or advertising. And since this area is upon the face of the card, the material printed in this area does not have to be consistent throughout all of the cards in the deck to prevent the value of the card from being inadvertently disclosed.

Although the detailed description of the drawings is directed toward illustrating the above described embodiments and variants, it will be apparent, to one of ordinary skill in the art, that variations may be made to the embodiments and variants described herein without departing from the spirit of the invention presented herein. Therefore, the present invention is not limited to such embodiments, as variations and modifications may be made without departing from the scope of the present invention as claimed herein.

What is claimed is:

1. A playing card deck particularly suited for playing games of blackjack consisting essentially of:

fifty-two cards of identical external dimensions, said cards having a face and a back;

said faces of said cards having value identification means disposed therein;

said value identification means on sixteen cards of said fifty-two cards having only an alphanumeric indicia of a value of ten;

said value identification means on four other cards of said fifty-two cards having only an alphanumeric indicia of a value of ace;

and said value identification means on four cards each of the remaining said cards having only alphanumeric indicia of a value of two, three, four, five, six, seven, eight and nine respectively, wherein the value of each of said 52 cards is indicated only, by said alphanumeric indicia of said value identification means.

2. The playing card deck particularly suited for playing games of blackjack as recited in claim 1 wherein:

said value identification means is disposed near an upper corner and disposed near an opposing lower corner of said face of said card.

3. The playing card deck particularly suited for playing games of blackjack as recited in claim 2 further consisting essentially of:

an area located centrally on said face of said cards where information not required for play of the game is displayed.

4. A playing card deck particularly suited for playing games of blackjack consisting acc; essentially of:

fifty-two card of identical external dimensions, said cards having a face and a back;

said faces of said cards having value identification means disposed therein;

said value identification means on sixteen cards of said fifty-two cards having only an alphanumeric indicia of a value of ten;

said value identification means on four other cards of said fifty-two cards having only an alphanumeric indicia of a value of ace;

secondary value identification mean having only an alphanumeric indicia of a value of eleven, disposed on said faces of said four other cards of said fifty-two cards with said value identification means having only an alphanumeric indicia of a value of ace;

and said value identification means on four cards each of the remaining said cards having only alphanumeric indicia of a value of two, three, four, five, six, seven, eight and nine respectively, wherein the value of each of said fifty-two cards is indicated only, by said alphanumeric indicia of said value identification means, and by said alphanumeric indicia of said secondary value identification means on said four other cards of said fifty two cards having a value of ace.

5. The playing card deck particularly suited for playing games of blackjack as recited in claim 2 wherein:

said value identification means is disposed near an upper corner and disposed near an opposing lower corner of said face of said card and said secondary value identification means is disposed in near proximity to said value identification means near said upper corner and disposed in near proximity to said value identification means near said lower corner.

6. The playing card deck particularly suited for playing games of blackjack as recited in claim 5 further consisting essentially of:

an area located centrally on said face of said cards where information not required for play of the game is displayed.

7. The playing card deck particularly suited for playing games of blackjack as recited in claim 4 wherein:

said value identification means is disposed near an upper corner and disposed near an opposing lower corner of said face of said card and said secondary value identification means is disposed near a second upper corner adjacent to said upper corner near said value identification means and disposed near an opposing second lower corner adjacent to said lower corner near said value identification means.

8. The playing card deck particularly suited for playing games of blackjack as recited in claim 7 further consisting essentially of:

an area located centrally on said face of said cards where information not required for play of the game is displayed .

9. The playing card deck particularly suited for playing games of blackjack as recited in claim 2 wherein identification means:

said value identification means is disposed near an upper corner and disposed near an opposing lower corner of said face of said card and said secondary value identification means is indicating a centrally located on said face of said card.

10. A playing card deck particularly suited for playing games of blackjack comprising:

fifty-two cards of identical external dimensions, said cards having a face and a back;

said faces of said cards having value identification means disposed therein;

sixteen of said fifty-two cards having a value identification means indicating a value of ten, and said value identification means indicating a value of ten printed in a distinct color;

four other cards of said fifty-two cards having said value identification indicating a value of ace, and said value identification means indicating a value of ace printed in a distinct color;

and four cards each of the remaining said cards having said value identification means indicating values of two, three, four, five, six, seven, eight and nine respectively, and said value identification means indicting values of two, three, four, five, six, seven, eight and nine printed in a distinct color.

* * * * *

UNITED STATES PATENT AND TRADEMARK OFFICE

CERTIFICATE OF CORRECTION

PATENT NO. : 6,695,313 B1
DATED : February 24, 2004
INVENTOR(S) : James M. Blane It is certified that error appears in the above-identified patent and that said Letters Patent is hereby corrected as shown below:

Column 6,
Line 31, delete “acc;”
Line 60, after “claim” change “2” to -- 4 --,.

Column 7,
Line 24, after “claim” change “2” to -- 4 --,.
Lines 24-25, after “wherein” delete “identification means”

Column 8,
Line 2, after “is” delete “indicating a”

Signed and Sealed this

Third Day of August, 2004

JON W. DUDAS
*Acting Director of the United States Patent and Trademark Office*